US007044301B2

(12) United States Patent
Houze

(10) Patent No.: US 7,044,301 B2
(45) Date of Patent: May 16, 2006

(54) PRODUCT POSITIONING RETENTION PACKAGE

(75) Inventor: David Houze, Coconut Grove, FL (US)

(73) Assignee: Noven Pharmaceuticals, Inc., Miami, FL (US)

( * ) Notice: Subject to any disclaimer, the term of this patent is extended or adjusted under 35 U.S.C. 154(b) by 13 days.

(21) Appl. No.: 10/747,827

(22) Filed: Dec. 29, 2003

(65) Prior Publication Data

US 2004/0168945 A1 Sep. 2, 2004

Related U.S. Application Data

(60) Provisional application No. 60/436,760, filed on Dec. 27, 2002.

(51) Int. Cl.
*B65D 73/00* (2006.01)
*A61L 15/00* (2006.01)

(52) U.S. Cl. ..... 206/484; 206/440

(58) Field of Classification Search ..... 206/484, 206/484.1, 466, 440; 383/38, 40
See application file for complete search history.

(56) References Cited

U.S. PATENT DOCUMENTS

| | | | | |
|---|---|---|---|---|
| 2,325,021 | A * | 7/1943 | Salfisberg | 206/466 |
| 2,976,988 | A * | 3/1961 | Schneider | 206/484 |
| 3,155,282 | A * | 11/1964 | LeBlanc | 206/484 |
| 3,199,437 | A * | 8/1965 | Nelsen | 383/38 |
| 3,550,764 | A * | 12/1970 | Tigner | 206/484 |
| 3,613,680 | A * | 10/1971 | Zamarra | 383/38 |
| 4,002,264 | A * | 1/1977 | Marchesani | 206/205 |
| 4,666,040 | A | 5/1987 | Murata | |
| 5,115,913 | A | 5/1992 | Anhauser et al. | |
| 5,176,258 | A | 1/1993 | Antal | |
| 5,407,066 | A | 4/1995 | Grange | |
| 5,413,567 | A | 5/1995 | Barth et al. | |
| 5,423,737 | A | 6/1995 | Cartmell et al. | |
| 5,439,100 | A | 8/1995 | Gordon et al. | |
| 5,505,306 | A | 4/1996 | Akemi et al. | |
| 5,518,114 | A | 5/1996 | Kohring et al. | |
| 5,628,724 | A | 5/1997 | DeBusk et al. | |
| 5,950,830 | A | 9/1999 | Trigger | |
| 6,227,359 | B1 * | 5/2001 | Truluck | 206/484 |
| 6,440,513 | B1 | 8/2002 | Kibele et al. | |
| 6,467,621 | B1 | 10/2002 | Ishida | |
| 6,499,595 | B1 | 12/2002 | Petricca | |
| 6,571,983 | B1 | 6/2003 | Schumann et al. | |
| 6,622,865 | B1 | 9/2003 | Theobald | |
| 6,648,140 | B1 | 11/2003 | Petricca | |
| 6,655,112 | B1 | 12/2003 | Cremer et al. | |
| 6,722,495 | B1 | 4/2004 | Fresnel | |
| 2003/0152300 | A1 * | 8/2003 | Tu et al. | 206/484 |
| 2004/0159575 | A1 * | 8/2004 | Shudo et al. | 206/484 |

FOREIGN PATENT DOCUMENTS

| | | |
|---|---|---|
| CA | 2296271 | 7/2000 |
| GB | 1589273 | 5/1981 |

* cited by examiner

*Primary Examiner*—Bryon P. Gehman
(74) *Attorney, Agent, or Firm*—Jay G. Kolman, Esq.

(57) ABSTRACT

A product retention package is disclosed, wherein the package is configured to form a sealed internal cavity for receiving a product, particularly transdermal delivery systems, patches, bandages, films, sheets, and the like. A retention apparatus is formed in association with the cavity to maintain the position of the product distal to a predetermined opening location. By controlling the position of the product within its packaging, the user can more easily and safely open the package at its predetermined opening location without damaging the product.

15 Claims, 3 Drawing Sheets

PRODUCT POSITIONING RETENTION PACKAGE

This application claims priority to U.S. Provisional application No. 60/436,760, filed Dec. 27, 2002.

TECHNICAL FIELD

The invention relates to compositions and methods for packaging planar or flat products, such as transdermal delivery systems, patches, bandages, films, sheets, and the like, that maintain the integrity and location such product within the package prior to its removal. By controlling the location of such products within their packaging, damage to the product can be prevented upon opening of the package.

BACKGROUND OF THE INVENTION

Product packaging is typically configured in a manner that defines a space or cavity to surround its contents in order to provide transportability and protection of its contents from the environment prior to opening. The product packaging can be flexible or rigid. Suitable materials, whether used singularly, in combination, or as laminates, which can be cold-sealed, heat-sealed, or flood or pattern coated with natural or synthetic adhesives or as co-extrusions to form the packaging are known and include polyethylene, polyester, polypropylene, polyurethane, polyolefin, polyvinyl alcohol, polyvinylchloride, polyvinylidene, polyamide, vinylacetate resins, BAREX®, ethylene/vinyl acetate copolymers, ethylene/ethyl acrylate copolymers, metal-vapor deposited films or sheets thereof, rubber sheets or films, expanded synthetic resin sheets or films, non-woven fabrics, fabrics, knitted fabrics, clothes, foils, papers or other suitable materials.

In many situations, the packaging associated with its product must have certain characteristics to allow effective use or performance of the package or its contents. When packaging planar or flat products, such as transdermal delivery systems, patches, bandages, films, sheets, and the like, it is generally preferable to minimize the package cavity. This is particularly true for such products that are individually packaged. Opening such packaging typically requires great care so as to not tear, cut or otherwise damage the product at the same time.

Transdermal drug delivery systems, which incorporate a drug or other agent into a carrier composition for topical administration and absorption through the skin or mucosa of the user, often require specialized or more durable packaging to maintain certain properties of the transdermal system prior to opening of its packaging. Such packaging may be a multi-layer or laminate material configured into a pouch or envelope, sealed around the product by heat sealing or an adhesive seal, in order to minimize degradation of the drug or agent and/or increase storage stability. In other instances, it may be desirable or necessary to have the product packaging made child-resistant by using tear-resistant, laminate or thicker materials for at least the outer portion of the package. For many transdermal systems, light, air or water can damage or cause degradation making it desirable to use impermeable materials, particularly for the outside layer of the package, which are opaque. Opaque packaging prevents the user from adequately determining where the patch is located in the package.

With packaging of these types, substantial force or a mechanical means such as scissors or other cutting device will be required thereby increasing the possibility of damaging the integrity of the patch upon opening the packaging. Even with packaging that provides a means to facilitate opening, such as a pre-cut edge slit or perforations, the user still cannot adequately determine where the patch is located upon opening. Moreover, inefficient tearing or opening can still result in product damage as well.

The foregoing illustrates limitations known to exist in present packages for transdermal delivery systems. The present invention provides compositions and methods for maintaining the integrity of the patch within its package that facilitates removal of the patch without risk of damage by providing one or more retention means formed of the package itself that acts to restrict movement of the patch away from the desired or predetermined area for opening the package.

The present invention relates to unit packaging for transdermal drug delivery systems particularly but not exclusively. The invention is equally applicable to the packaging of medical, veterinary and non-medical and non-veterinary patches and bandages for application to human or animal skin or mucosa.

SUMMARY OF THE INVENTION

It is an object of this invention to provide a product retention package for a transdermal drug delivery system or other planar or flat product that ensures the integrity of the product upon opening of the package, particularly when the package is opened with the aid of a mechanical means such as scissors.

It is also an object of this invention to provide a product retention package for a transdermal drug delivery system or other planar or flat product that comprises an internal cavity for receiving the product within a sealed or closed periphery wherein at least one retention means is provided along at least one side of the cavity to restrict the product in a desired location within the cavity or away from a predetermined cutting line or opening area. The retention means can comprise a portion of the product package which is sealed together to form a dimple, recess, indent, or closure of the package material, or an opening cut through the packaging material with its edges sealed, in any form or shape, and particularly a square rectangle, circle, semi-circle, or ellipse, at a position interior to the predetermined cutting line or area, or to maintain the location of the product within the cavity away from a predetermined cutting line or area The product package may also be sealed along a line or arc from a point along one periphery edge to another periphery edge point that results in dividing the cavity into one or more smaller cavities, one containing the product and the one or more other cavities being where the user will tear, cut or otherwise open the package.

It is still another object of this invention to provide a product retention package that comprises at least a first and second layer being sealed to form a periphery and thereby defining an internal cavity for receiving a product. At least one retention means is provided along at least one side of the cavity to maintain the product in a desired position within the cavity. The at least one retention means may prevent movement of the product into a predetermined zone within the cavity, or across a package opening position or line where the user will tear, cut or otherwise open the package. At least one retention means may comprise a portion of the at least first and second layers which is sealed together at a position interior to the predetermined line position or to maintain the position of the product in the cavity at a location distal from the predetermined position or line.

It is also an object of this invention to provide a method for packaging a product comprising the steps of providing a product to be packaged, and a package having a sealed peripheral region surrounding a product within a cavity. The product is positioned in the cavity, and maintained in a predetermined area with respect to a predesignated position within the cavity.

It is still another object of this invention to provide a method of ensuring the integrity of a packaged product when opening the package. A means is provided in association with a product package containing cavity for restricting movement of the product across a predetermined line or area within the cavity adjacent at least at one portion of the cavity. The predetermined position may be located adjacent at least at one end of the cavity, wherein at least one retention means extends into or borders the cavity from a sealed peripheral region and serves to maintain the position of the product in the cavity distal from the predetermined position. The package is opened by accessing the cavity at the location of the predetermined position, whereby the integrity of the product is maintained upon opening of the package.

For a better understanding of the present invention, together with other and further objects and disadvantages thereof, reference is made to the following description taken in conjunction with the accompanying drawings, and its scope will be set forth in the appended claims.

DETAILED DESCRIPTION OF THE INVENTION

As used herein, the term "cavity" is used with reference to a package or other container, which contains a product, such as a transdermal delivery system, and is sealed on at least one side. A product retention package 10 may be may be rigid or flexible and formed from one or more layers of materials known in the art that have been folded and sealed all along their edges, or along all non-folded edges, to form the cavity 16. The product package 10 can be in any convenient form that permits the effective closure for product 18, such as a cavity a bag, pouch, sachet or pocket. The perimeter of the cavity can be in any design, shape or form, irregular or uniform. Uniform shapes such as squares, rectangles, circles and ovals are preferred in order to facilitate the sealing and manufacturing processes. Sealing can be accomplished by heat, ultrasound, laser, adhesive, or any other suitable method. The cavity 16 may be hermetically sealed if desired, and for many applications the packaging material and sealing are designed to provide the appropriate protection from the external environment. The preferred packaging material is self-sealing meaning that it is able to form a stable bond between two facing surfaces of the same material without the use of an adhesive.

Figure 1:
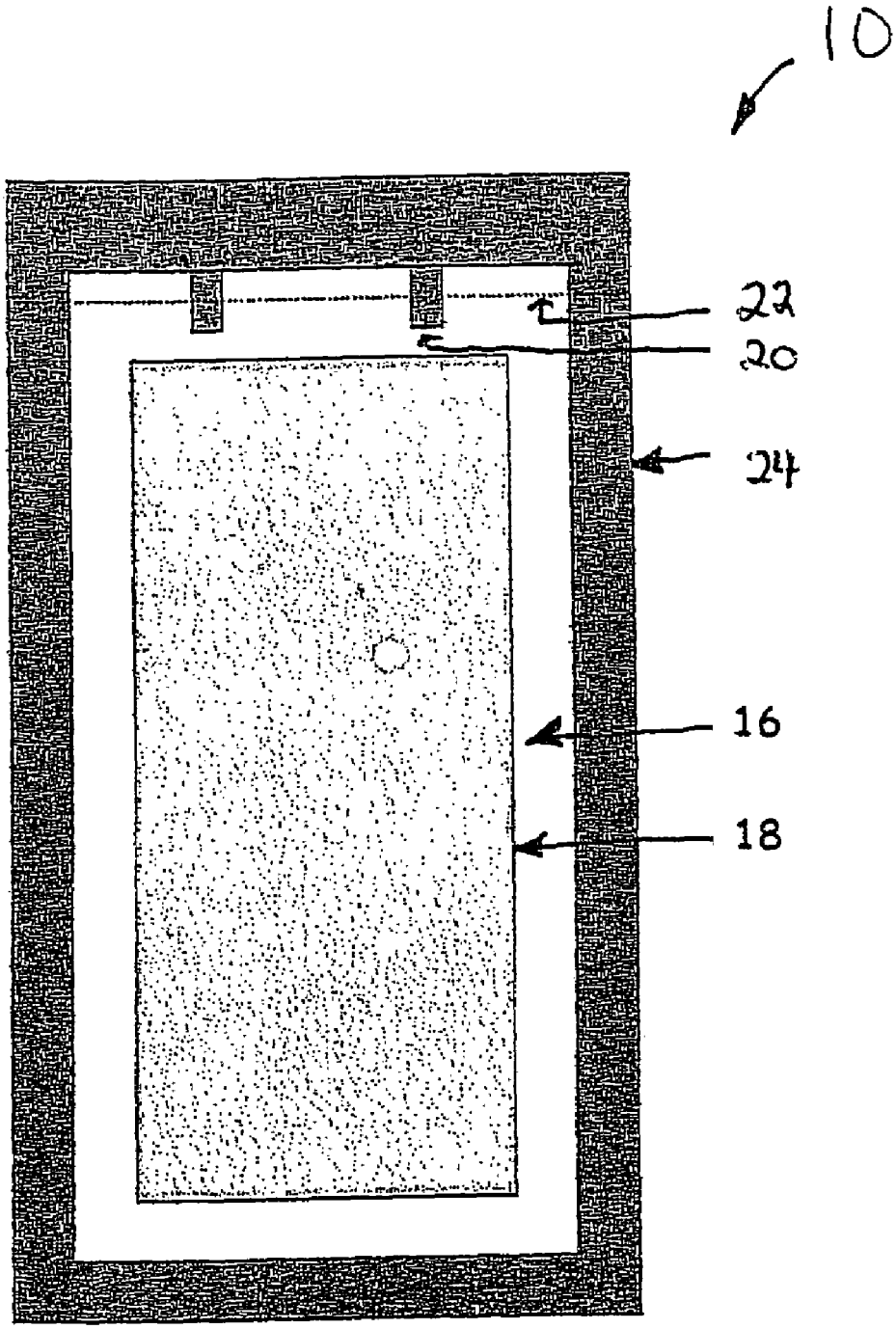
FIG. 1 is a cut away plan elevation view of a preferred embodiment of the product retention package.

In a preferred embodiment as shown in FIG. 1, the packaging material is sealed along its edges to form the peripheral seal 24 that extends around the cavity 16, forming an enclosed product containing area. Within the cavity 16 is positioned a product 18, which may be transdermal delivery system or other product suitable for packaging in this manner. The package 10 comprises at least one retention means 20 that extends from the sealed periphery 24 into the cavity 16. The product 18 as located within the cavity 16 of the package 10 is restricted within the certain confines of the cavity 16. The retention means 20 prevent the product 18 from migrating to a position which intersects a predetermined line or position 22. Predetermined line or position 22 is designed to be the location at which a user will open package 10 by cutting, tearing or otherwise breaking the periphery seal 24 to access the product 18 within cavity 16. The retention means 20 prevents movement of product 18 to a position where it could be damaged by opening of package 10. In this way, retention means 20 thereby protects product 18 when the package 10 is cut or opened along the predetermined position 22. The predetermined position 22 can be represented as, but is not limited to, a solid or broken line printed on the periphery of the package 10. The predetermined position 22 can also be a perforation located at one periphery seal 24 side and extending across all or a part of package 10 to the opposite periphery seal 24 side, or a perforation or slit only on the periphery seal 24 on either or both such sides of the package 10. The retention means 20 extends from at least one side across or beyond a predetermined position that represents where the package can be opened, such as by a mechanical means including scissors, a razor blade, or other sharp cutting object.

Figure 2:
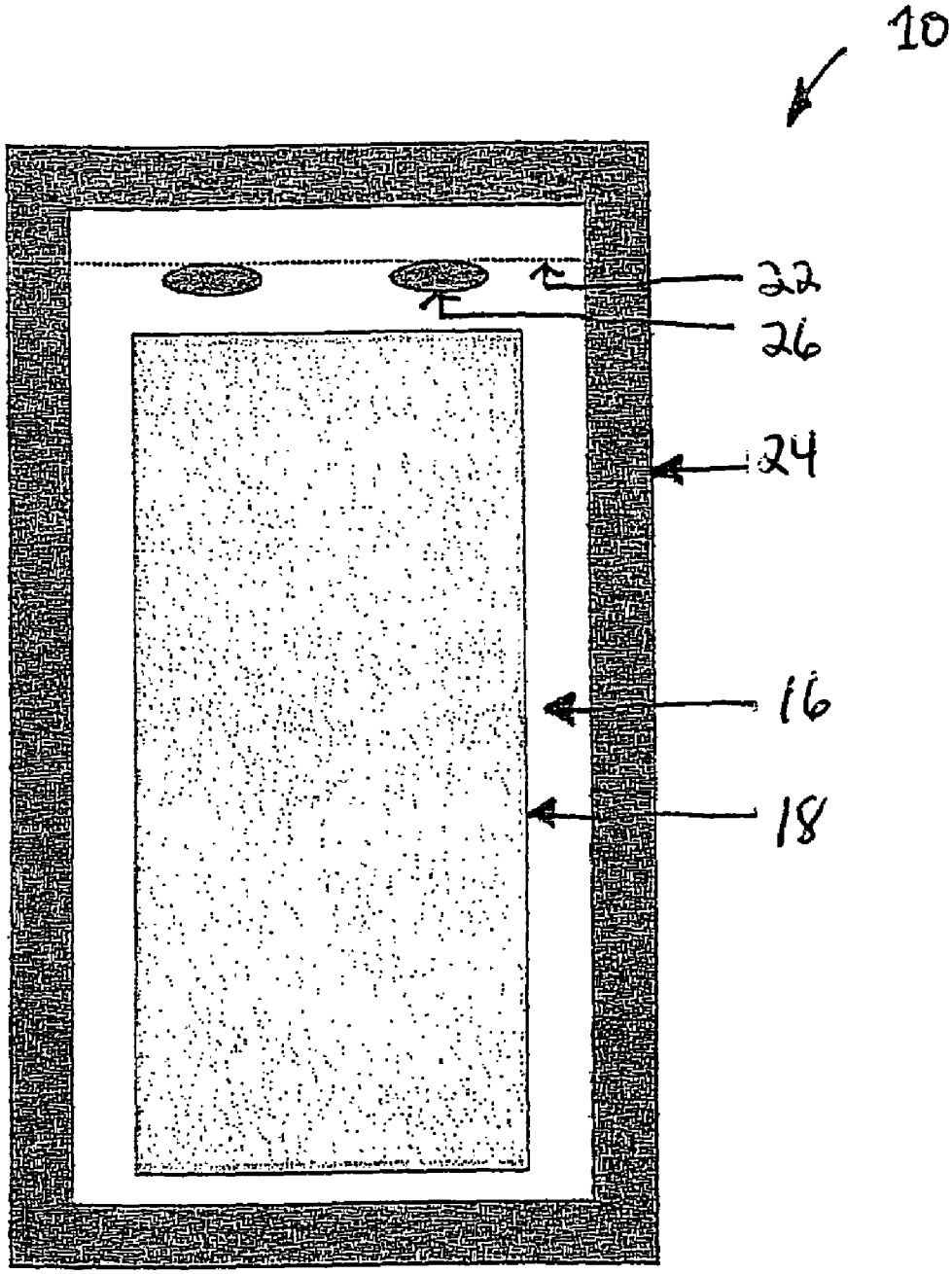
FIG. 2 is a cut away plan elevation view of an alternate embodiment of the product retention package.

In another embodiment of the present invention as shown in FIG. 2, the package 10 shows sealed retention means or areas 26 that are separate from the sealed periphery 24, but are positioned internal to the cavity 16. The product 18 is located within the cavity 16 of the package 10 and can move within the confines on the cavity 16. The retention areas 26 also prevent the product 18 from migrating up to a position which intersects the predetermined line or position 22, thereby protecting product 18 when the package 10 is cut or otherwise opened along the predetermined position 22. Again, the predetermined position 22 can be represented as, but is not limited to, a solid or broken line printed on the periphery of the package 10. The predetermined position 22 can also be a perforation located at one periphery seal 24 side and extending across all or a part of package 10 to the opposite periphery seal 24 side, or a perforation or slit only on the periphery seal 24 on either or both such sides of the package 10. The retention areas 26 are located at a position internal to the predetermined line 22 that represents the desired location at which the package can be torn or opened by a mechanical means, such as scissors, razor blade, or other sharp object.

Alternatively, sealed retention means or areas 26 as shown in FIG. 2 may instead be cut-outs or punch-outs (i.e., openings) having only their peripheral edges sealed and function the same in preventing the product 18 from migrating up to a position which intersects a predetermined opening line or area 22.

Additionally, predetermined opening line or area 22 may be omitted altogether and the package 10 opened by cutting or tearing directly through the sealed or open retention means or area 20 or 26 by without the aid of a package guideline or position 22.

While a product package cavity can be formed of a single film or layer alone, it may be desirable to provide one or more secondary or outer layers in order to augment the package's maintenance and stabilizing properties, to increase tear resistance such that the package may function as a childproof package, and/or to provide a more cosmetically appealing covering.

Figure 3:
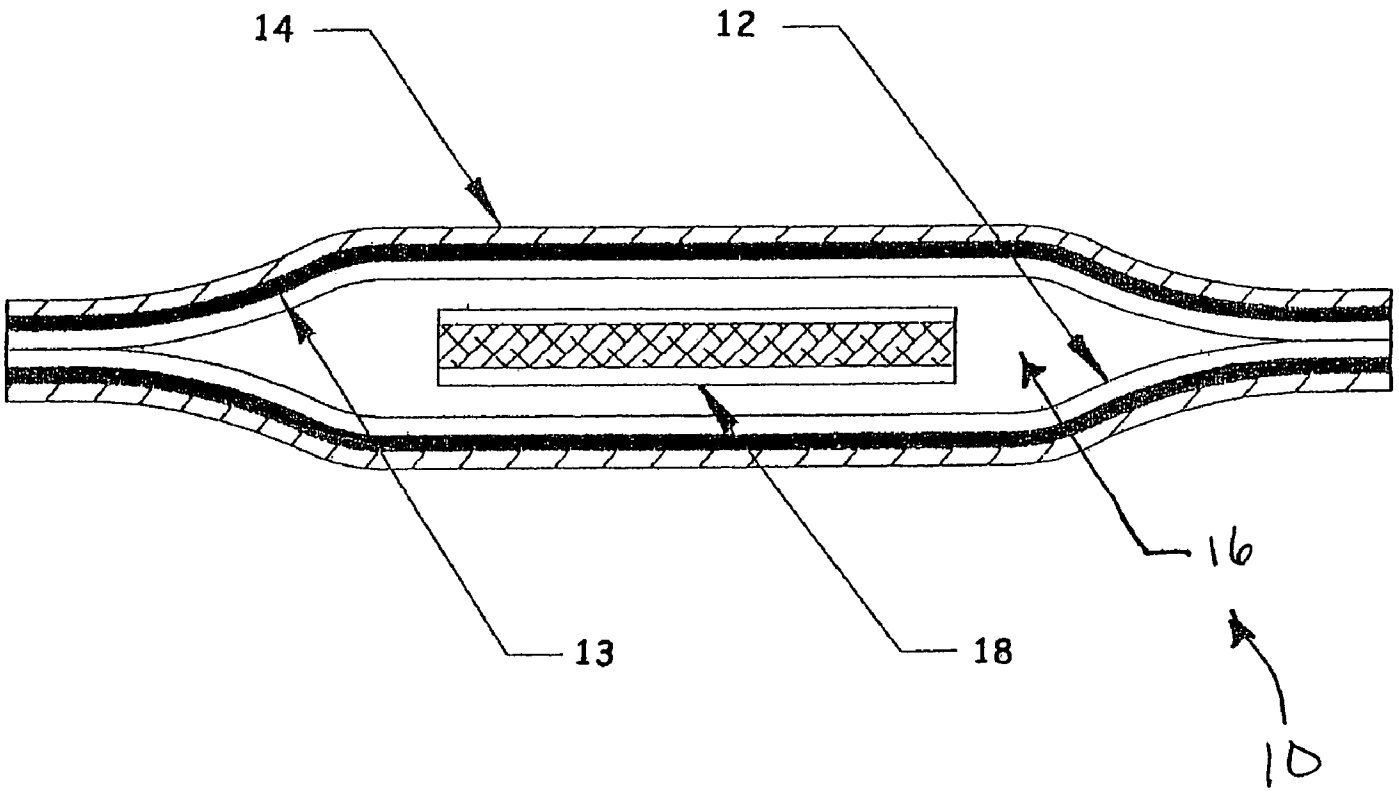
FIG. 3 is a cross-sectional view of a multiple layer composition of the packaging material in a particularly preferred embodiment of the product package used to form a cavity.

For example, in a preferred embodiment for use with transdermal drug delivery systems as shown in FIG. 3, the product packaging material is a laminate comprising (a) primary layer 12 that will not significantly absorb the drug or other components of the product 18, or otherwise negatively affect the physical characteristics of the drug or other components of the tproduct 18, and (b) secondary layer 14 that augments the maintenance and protection characteristics of the inner layer 12, but further imparts increased tear resistance such that the packaging material is substantially child resistant/proof Inner layer 12 may be a thermoplastic polymer and is preferably self-sealing. In this embodiment of the invention, the thickness of inner layer 12 may be from about 0.5 mil to about 2.5 mil, and more preferably from about 0.75 mil to about 1.5 mil, but other thicknesses may be used. While thinner and thicker widths may be employed, inner layer 12 should not be so thin so as to adversely affect protecting or maintaining product 18 within cavity 16, nor too thick so as to adversely effect sealing and packaging properties, such as sealing to form a cavity 16.

The one or more secondary layer(s) 14 can be films or laminates comprising any suitable materials known in the art for packaging including as foils, polyethylenes, polyesters, vinyl acetate resins, ethylene/vinyl acetate copolymers, polyvinyl chloride, woven and non-woven fabric, cloth and papers. Particularly preferred are polyesters such as those commercially sold under the trademark Mylar® and Melinex by E. J. du Pont de Nemours and Company, Wilmington, Del., and Mylar® S, Melinex® S, and Melinex® 800 polyester films.

In order to provide protection from light for drugs or other agents or materials in package 10 that may be subject to degradation by light, it may be desirable to use a modified form of secondary layer 14 material. For example, the material may be tinted to provide a partial barrier affecting only certain wavelengths of light, or be substantially opaque as in a metalized polyester film that can include an aluminum foil layer.

In practice of the preferred embodiments of the invention, the thickness of secondary layer 14 may be from about 0.2 mil to about 3.0 mil, more preferably from about 0.2 mil to about 1.5 mil, and even more preferably from about 0.2 mil to about 1.0 mil. While thinner and thicker widths may be employed, secondary layer 14 may be designed so as to not compromise any desired barrier and tear resistance properties.

Secondary layer 14 can be affixed to primary layer 12 by any technique known in the art. Attachment by means of heat fusion or an adhesive, particularly a laminating adhesive, is preferred. Use of an adhesive 13 may be preferred in order to achieve greater tear resistance properties that are desirable in creating child-resistant/proof packaging.

As described above, the present invention provides a package for maintaining the integrity of the packaged system upon opening of the package. However, it should be noted that multiple configurations exist for the retention means or areas. Further, possibilities include having the retention means or areas extending along a plurality of sides, locations, or angles, thereby securely maintaining the packaged product in a selected or desired position within the cavity of the package as well as away from opening areas.

It is understood that the specification and examples are illustrative but not limiting of the present invention and that other embodiments within the scope of the invention will suggest themselves to those skilled in the art.

What is claimed is:

1. A product retention package having an internal cavity in which a product is positioned, characterized in that:

at least one layer of a product packaging material is sealed to form the internal cavity for receiving the product;

at least one retention means positioned in a predetermined position in the cavity;

where the at least one retention means restricts movement of the product across a location within the cavity to maintain the position of the product positioned in the cavity distal from a location for opening the product package;

wherein the at least one retention means is selected from the group consisting of (i) a sealed portion of the product packaging material extending from the sealed periphery formed about the cavity and into the cavity bisected by the location for opening the product package;

(ii) one or more sealed portions of the product packaging material separate and internal to the periphery formed about the cavity;

(iii) one or more openings through the product packaging material and sealed along their periphery located internal to the periphery formed about the cavity; and wherein the location of the at least one retention means is the location for opening the product package.

2. The product package of claim 1, wherein sealing is accomplished by means selected from the group consisting of heat, ultrasound, laser and adhesives.

3. The product package of claim 1, wherein the at least one layer of the product packaging material being sealed to form an internal cavity for receiving the product is self-sealing.

4. The product of claim 1, wherein the at least one layer of product packaging material being sealed to form an internal cavity is selected from the group consisting of polyethylene, polyester, polypropylene, polyurethane, polyoflefin, polyvinvyl alcohol, polyvinyl chloride, polyvinylidene, polyamide, vinyl acetate resins, BAREX, ethylene/vinyl acetate copolymers, ethylene/ethyl acrylate copolymers, metal vapor deposited films or sheets, rubber sheets or films, expanded synthetic resin sheets or films, non-woven fabrics, knitted fabrics, other fabric, clothes, foils and papers.

5. The product package of claim 1, wherein the at least one layer of product packaging material being sealed to form an internal cavity is opaque.

6. The product package of claim 1, wherein the location at which the product package is opened is identified on the outside of the package.

7. The product package of claim 1, wherein the location for opening the product package is severed with the aid of a mechanical means to open the package.

8. The product package of claim 1, wherein the product is a planar transdermal delivery system.

9. The product package of claim 1, wherein the at least one layer of product packaging material being sealed to form an internal cavity is formed into a pouch sealed along the entire periphery.

10. The product of claim 9, wherein the location for opening the product package traverses a first edge of the sealed periphery, through the cavity, and then through a second edge of the sealed periphery.

11. The product package of claim 1, wherein the product packaging material further comprises an outer product packaging material layer affixed to an inner product packaging material layer.

12. The product package of claim 11, wherein the inner product packaging material layer is self-sealing and the outer product packaging layer is selected from the group consisting of oils, polyethylenes, polyesters, vinyl acetate resins, ethylene/vinyl acetate copolymers, polyvinyl chloride, woven and non-woven fabrics, cloths and papers.

13. The product package of claim 11, wherein the outer product packaging material layer is affixed to the inner packaging material layer by means of an adhesive.

14. The product package of claim 11, wherein the at least one retention means comprises a sealed potion between the inner and outer product packaging material layers.

15. The product package of claim 1, wherein the product package is tear-resistant.

* * * * *